United States Patent [19]

Turner et al.

[11] Patent Number: 4,628,677

[45] Date of Patent: Dec. 16, 1986

[54] FRICTION SPINNING

[75] Inventors: Nicholas J. Turner, Altrincham; Geoffrey A. Ogden, Rochdale; Richard S. Bridge, Ramsbottom, all of England

[73] Assignee: Magnavac Air Systems Limited, Oldham, England

[21] Appl. No.: 775,618

[22] Filed: Sep. 13, 1985

[30] Foreign Application Priority Data

Sep. 15, 1984 [GB] United Kingdom ..... 8423362
Feb. 22, 1985 [GB] United Kingdom ..... 8504600

[51] Int. Cl.[4] ..... D01H 11/00; D01H 1/135; D01H 7/885

[52] U.S. Cl. ..... 57/301; 57/304; 57/308; 57/401; 57/411

[58] Field of Search ..... 57/301, 302, 304, 401, 57/411, 400, 415, 308

[56] References Cited

U.S. PATENT DOCUMENTS

| | | | |
|---|---|---|---|
| 2,845,139 | 7/1958 | Berberich et al. | 57/304 X |
| 2,924,063 | 2/1960 | Datwyler | 57/304 |
| 3,060,673 | 10/1962 | Anderson et al. | 57/304 X |
| 4,399,650 | 8/1983 | Parker et al. | 57/401 |

*Primary Examiner*—John Petrakes
*Attorney, Agent, or Firm*—Bell, Seltzer, Park & Gibson

[57] ABSTRACT

In a friction spinning process, a method is provided for preventing build up of dust and fly etc. inside a friction spinning machine (1) which method comprises the steps of introducing into the machine a flow of filtered air at a pressure just sufficient to substantially prevent the ingress of unfiltered air during spinning. The invention also provides apparatus for performing the method described, which apparatus comprises filter means (19), pressurizing means (20), ducting (22, 23) adapted to permit the outflow of clean pressurized air into the inside of the machine (1) adjacent the or each spinning head (3) at a pressure sufficient to substantially prevent the ingress of unfiltered air during spinning.

8 Claims, 2 Drawing Figures

FRICTION SPINNING

This invention relates to improvements in or relating to friction spinning and more particularly to the problem of substantially eliminating the build-up of dust and fly etc. within the spinning machine during the spinning process.

Open-end or break-spinning machines are known, such as is shown in UK Pat. No. 1311420, in which the rotor or turbine spinning head comprises a chamber adapted to be rotated at high speed, typically 90,000 rpm, onto the inner surface of which is continuously deposited fibrous material which is then drawn off as twisted yarn under relatively high tension. The Patent describes a method of controlling the atmospheric conditions around the spinning rotor which are usually characterised by high temperatures caused by the high rotational speeds of the spinning rotor. Such temperatures can cause a loss of moisture which impairs the quality of the spun yarn and because of the high tensions involved, end-breaks occur from time to time. The invention described in the Patent overcomes this problem by blowing a current of cooling air onto the exterior surface of the rotor, which current of air is prevented from interfering with the normal operation of the spinning chamber by being separated from it by means of a baffle plate which fits snugly around the portion of the rotor of the greatest circumference such that the plate forms an enclosed chamber with the part of the housing on the opposite side of the rotor from which yarn is spun.

An alternative method of spinning has been proposed which is not characterised by high rotational speeds of the machine parts and hence is not affected by the relatively high temperatures normally associated with open-end rotor spinning. This alternative method of spinning, which utilises a pair of friction rolls, is called friction spinning and is described in detail in an article by Dipl-Ing. K. J. Brockmanns in pages 5 to 23 of the International Textile Bulletin, Yarn forming 2/84 and pages 15 to 32 of the International Textile Bulletin, Yarn forming 3/84. From this article, it is apparent that the major technical advance in respect of friction spinning as opposed to open-end rotor spinning is that the former employes relatively modest spinning speeds, typically less than 10,000 rpm but has a much higher throughput of yarn, typically 200 to 300 meters per minute.

However, in friction spinning a substantial volume of air is necessary to provide the required high pressure suction through the perforated friction rollers and trash box and this large volume flow of air tends to draw into the spinning machine large amounts of unwanted dust and fly etc. from the surrounding environment which then builds up inside the spinning machine. Such dust and fly, if it builds up to a sufficient extent, will clog up the perforations in the friction rollers and thereby adversely affect the pressure characteristics which are necessary for spinning the yarn. The ingress of dust and fly etc. will also tend to clog up the exposed working parts and ducting within the machine which can also adversely affect the quality of the spun yarn. Furthermore, because of the requirement for independent access to each spinning head by an operator of the machine in order to attend to end breaks etc., it will be appreciated that each such head must be provided with a hinged cover having a slot-like aperture for receiving a respective doffing tube which projects outwardly from the machine. Each such aperture must be a loose fit over the respective doffing tube because of the pivotal movement of the cover and consequently an air leakage path around the outside of the doffing tube is inevitable.

The consequences of the ingress into each spinning head of the spinning machine of dust and fly etc. is that yarn of poor quality is spun. Whilst in a break-spinning machine such poor quality yarn would tend to break as soon as it was formed in view of the relatively high tension of the drawn yarn, with friction spinning this is not the case since it is inherently a low tension process. This means that if poor quality yarn is being spun it will continue to be spun by the machine until a sample is taken for analysis, after which the situation can be rectified.

It is known to utilise the principle of over-pressurisation within e.g. textile drive housings by providing a fresh air forced ventilation by which an excess pressure is maintained within the interior of the housing to thereby prevent the ingress of dust and fly etc. Whilst such a forced ventilation system can work satisfactorily to prevent e.g. overheating of drive motors due to large deposits of dust and fly resting upon them, it is not immediately apparent as to how such a system could effectively operate within a friction spinning machine which requires large quantities of air to be drawn into it in order to operate satisfactorily. If, for example, high pressure air hoses were located at intervals along the friction spinning machine in order to blow dust and fly out of the machine and thereby prevent ingress of it, the result would inevitably be an alteration in the flow characteristics of the air required for friction spinning, which would give rise to the production of poor quality yarn and hence defeat the object of the exercise.

According to the first aspect of the invention, there is provided a method of preventing the build up of dust and fly etc. inside a friction spinning machine, which method comprises the steps of introducing into the machine a flow of pressurised clean or filtered air at a volume flow rate just sufficient to substantially prevent the ingress of unfiltered air during spinning. The invention thus resides in the appreciation that by providing a supply of clean or filtered air sufficient to provide a positive pressure within the machine whilst also supplying the requirements for satisfactory spinning, the ingress of dust and fly can be substantially eliminated without altering the required flow characteristics of the machine.

According to a further aspect of the invention, there is provided apparatus for performing the method described, which apparatus comprises means to introduce into a friction spinning machine a flow of pressurised clean or filtered air at a volume flow rate just sufficient to supply the air required to be drawn through the perforated friction rollers for spinning and to provide a positive air pressure within the machine to prevent the ingress of dust and fly into the machine which could clog the perforated friction rollers and adversely affect the quality of the spun yarn.

The invention will now be described, by way of example only, with reference to the accompanying drawings in which.

Figure 1:
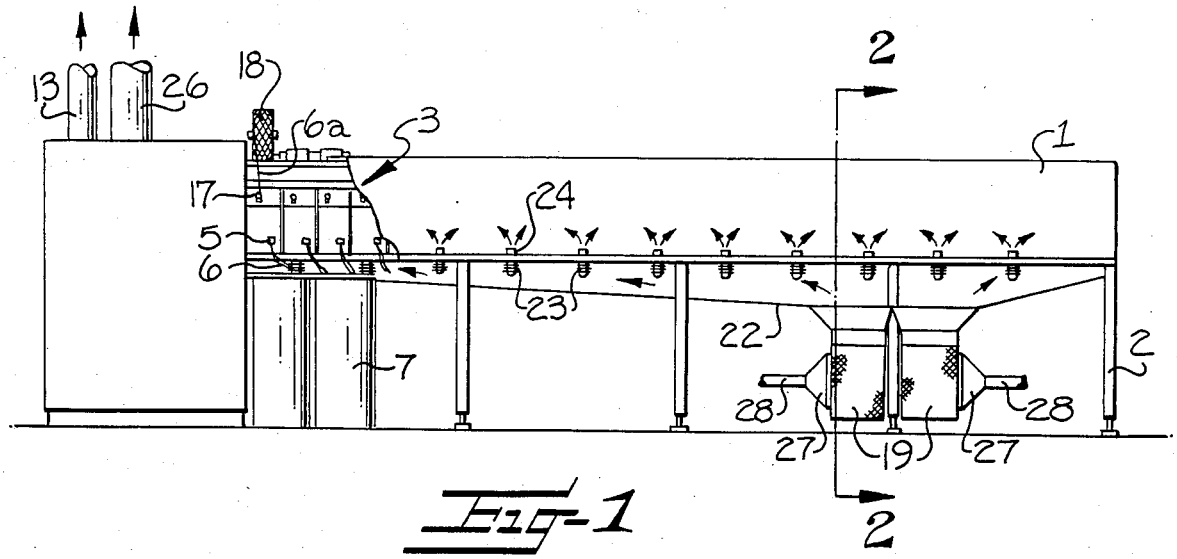
FIG. 1 is a schematic part cut-out side view of spinning apparatus according to the invention.

Referring to the drawings, an elongate spinning frame 1 is supported at intervals by legs 2 above which are disposed a set of forty-eight spinning heads 3 arranged symmetrically along each side of the spinning frame 1 in two rows of twenty four heads each. At one end of the spinning frame 1 is a drive housing 4 containing drive machinery (not shown).

Each spinning head 3 comprises a sliver inlet aperture 5 adapted to receive a sliver 6 from a sliver can 7 from where it is drawn by a feed roll 8. A combing out roller 9 beats and separates the sliver into fibres in a conventional manner. Large particles of impurities including seed, trash etc. liberated by the combing out roller 9 as it rotates is collected in a trash box 10 from where it is delivered under suction pressure along duct 11 to a trash exhaust duct 12 connected to a main trash exhaust pipe 13 which extends vertically from the housing 4 of the spinning frame 1 and is connected to a conventional filtration plant incorporating a suction fan (not shown).

Above the trash box exhaust ducts 12 (shown in FIG. 2) is disposed a main air exhaust duct 25, connected at the drive housing end of the spinning frame 1 to a single main air exhaust pipe 26 which extends vertically therefrom and is connected to the same filtration plant as the trash air exhaust pipe 13.

After each sliver 6 has been separated into fibres by a respective combing out roller 9 the fibres are drawn up a transfer tube 14 and fed into the nip between a perforated friction roller 15 and an imperforate friction roller 16, by which the fibres are spun into yarn 6a. To perform the spinning operation, a suction pressure of typically 12,000 Pascals is applied to the inside of the perforated roller 15, along the duct 29, from a main air exhaust duct 25. From the rollers 15, 16 the spun yarn 6a is fed through a respective doffing tube 17 and onto a take-up package 18 (only one of which is shown) above each spinning head 3.

The machine thusfar described is generally conventional.

Figure 2:
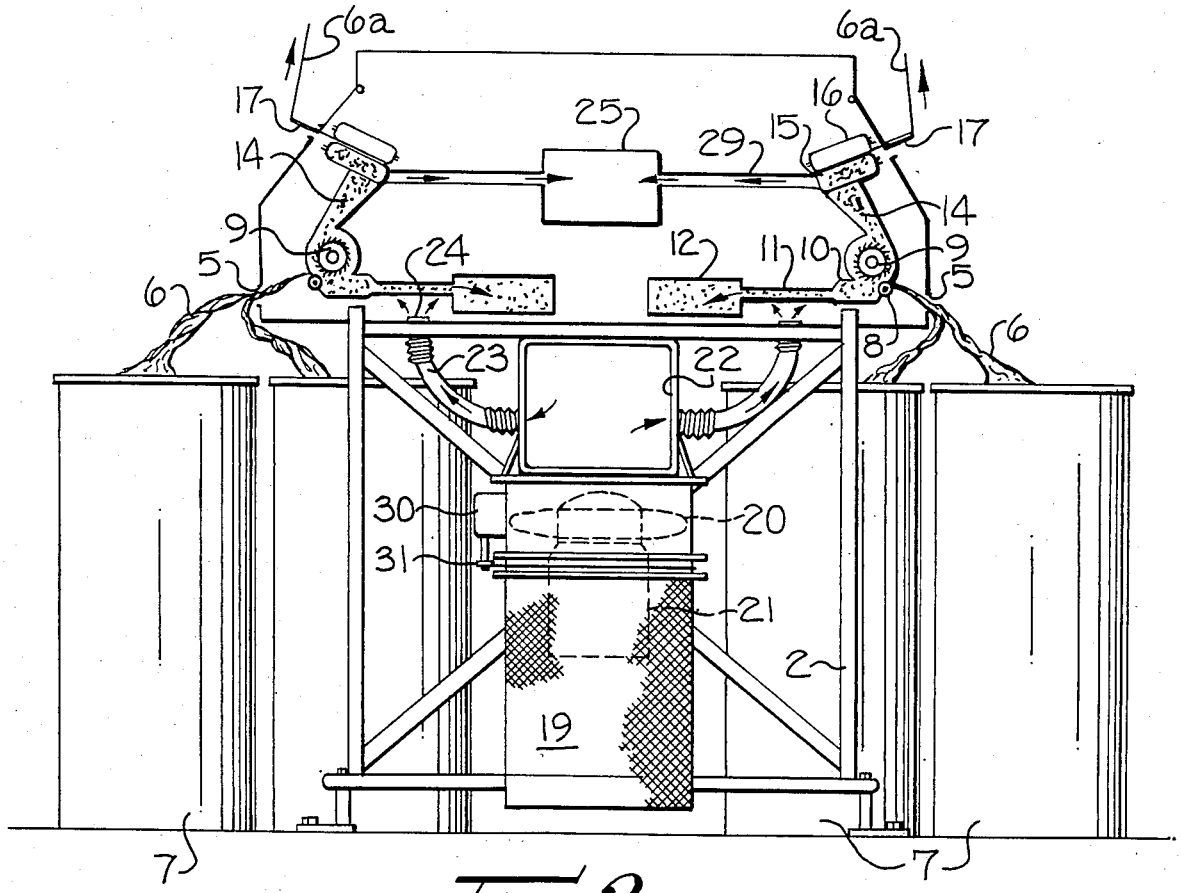
FIG. 2 is an enlarged sectional view along the and line "X—X" of FIG. 1.

The apparatus according to this embodiment of the invention comprises a pair of rotatable generally cylindrical filter elements 19 within which are disposed fans 20 driven by electric motors 21, shown in outline in FIG. 2. Above the filters 19 is a main air supply duct 22 which runs along the length of the spinning frame 1 and from each side of which projects at equally-spaced intervals a set of flexible hoses 23. Each of the hoses 23 is provided with a respective outlet nozzle 24 arranged such that each nozzle 24 is in the general vicinity of a respective spinning head 3.

Adjacent each of the filter elements 19, is a respective triangular vacuum nozzle 27 connected by ducting 28 to a conventional filter plant fan (not shown) such that, in use, dust and fly etc. which accumulates upon the filter units 19 is continuously removed. They are effectively self-cleaning, since each filter element 19 is rotated by a geared motor 30 and pulley belt 31.

In operation, as shown by the arrows, air is drawn in through and cleaned by each filter element and is then blown by the fans 20, along the main supply duct 22 and up into each hose duct 23 such that a balanced flow of air is emitted from the nozzles 24 and evenly distributed into the area surrounding each respective spinning head 3 inside the spinning frame 1. This flow of air forms a barrier which ensures that unfiltered air is not drawn into the spinning frame 1 through, for example, the apertures around the doffing tubes 17 and the clearances between each spinning head cover and the frame.

In practice, it has been found desirable to ensure that the flow of air from each filter unit 19 is supplied to the spinning heads 3 at a volume flow rate above that sufficient for the spinning process but only just sufficient to ensure that there is no ingress of unfiltered air into the machine, typically at a flow rate of 10% above that required for spinning such that an even pressure of up to 250 pascals is present within the spinning frame above ambient pressure. In particular, it has been found that if the flow rate is too great, i.e. there is a considerable outflow of filtered air from the machine, this not only tends to be wasteful but has the important disadvantage in that the pressure required to produce the outflow can adversely affect the pressure characteristics required by the friction spinning process.

It will be appreciated that the invention is not limited to the embodiment described but is intended to cover all kinds of apparatus which have the desired effect, as stated in the appended claims. For example, instead of filter means being provided on the spinning machine, it may be entirely separate, such that filtered air is channelled to the machine through ducting. It is also envisaged that the ducting could form part of a closed cycle in which air is continuously fed under pressure into the machine, exhausted, filtered and fed back again and so-on. As a further refinement each spinning head may be provided with its own supply of filtered air such that in the embodiment described each head is provided with a respective hose 23 and nozzle 24, to ensure that the air is evenly distributed.

I claim:

1. A method of preventing the build up of dust and fly in a friction spinning machine having perforated friction rollers upon which yarns are formed and a suction device for drawing a large volume of air through the perforated friction rollers in producing the yarns, said method comprising introducing into the spinning machine a flow of pressurized clean, filtered air at a volume sufficient to supply the air required to be drawn through the perforated friction rollers for spinning and to provide a positive air pressure within the machine to prevent the ingress of dust and fly into the machine which could clog the perforated friction rollers and adversely affect the quality of the spun yarn.

2. A method according to claim 1 wherein the pressurized clean, filtered air is introduced into the spinning machine at a volume flow rate about 10 percent above that needed to supply the air required for spinning.

3. A friction spinning machine comprising a series of yarn spinning stations including perforated friction rollers upon which yarns are formed, a spinning machine housing enclosing said spinning stations, suction means cooperating with each of said spinning stations for drawing a large volume of air through the perforated friction rollers in producing the yarns, and means for introducing into the enclosed housing a flow of pressurized clean, filtered air at a volume sufficient to supply the air required to be drawn through the perforated friction rollers for spinning and to provide a positive air pressure within the machine to prevent the ingress of dust and fly into the machine which could clog the perforated friction rollers and adversely affect the quality of the spun yarn.

4. Apparatus according to claim 3 in which the means for introducing a flow of clean, filtered air supplies the air at a volume flow rate about 10 percent above that needed to supply the air required for spinning.

5. Apparatus according to claim 3, in which the means to introduce a flow of clean, filtered air into the spinning machine comprises an electrically driven fan and a filter element connected by ducting to the machine.

6. Apparatus according to claim 5, in which the ducting is provided with one or more ducts adapted to distribute evenly filtered, clean air under pressure to each spinning head of the machine.

7. Apparatus according to claim 5, in which the filter element is self cleaning.

8. Apparatus according to claim 7, in which the filter element is rotated and the self cleaning thereof is effected by a nozzle adapted continuously to remove particles of dust and fly etc., under suction pressure, from the filter element.

* * * * *